US007341290B2

(12) United States Patent
Torka et al.

(10) Patent No.: US 7,341,290 B2
(45) Date of Patent: Mar. 11, 2008

(54) LOCK FOR VEHICLE DOORS OR LIDS

(75) Inventors: Artur Torka, Wuppertal (DE); Stephan Wietkamp, Münster (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 106 days.

(21) Appl. No.: 10/561,091

(22) PCT Filed: Jun. 9, 2004

(86) PCT No.: PCT/EP2004/006194

§ 371 (c)(1),
(2), (4) Date: Dec. 16, 2005

(87) PCT Pub. No.: WO2004/113655

PCT Pub. Date: Dec. 29, 2004

(65) Prior Publication Data

US 2006/0284425 A1 Dec. 21, 2006

(30) Foreign Application Priority Data

Jun. 21, 2003 (DE) ..... 103 27 997

(51) Int. Cl.
*E05C 3/06* (2006.01)

(52) U.S. Cl. ..... 292/201; 292/216

(58) Field of Classification Search ..... 292/216, 292/201; 49/280

See application file for complete search history.

(56) References Cited

U.S. PATENT DOCUMENTS 4,518,180 A * 5/1985 Kleefeldt et al. ..... 292/201

(Continued)

FOREIGN PATENT DOCUMENTS

DE 31 50 621 12/1986

(Continued)

*Primary Examiner*—Gary Estremsky
(74) *Attorney, Agent, or Firm*—Friedrich Kueffner

(57) ABSTRACT

According to the invention, when the door is locked, a locking part (10) is displaced into a rotary latch (20), which is first pivoted from its open position into a preliminary detent position. The rotary latch (20) is spring-loaded (25) in the direction of its open position and is usually supported on a catch (30) by means of an initial detent section (21). The rotary latch (20) is then rotated further by means of a motor-driven closing aid with the aid of a drive mechanism (53) and an eccentric element (50), until it reaches a primary detent position, in which the catch (30) rests on a primary detent section of the rotary latch (20). To obtain a reliable lock that can be universally used, a toggle-joint lever pair (40) and a spring-loaded follower (33) are provided between the eccentric element (50) and the rotary latch (20). One fixed end (41) of said toggle-joint lever pair (40) is rotatably mounted in a locally fixed bearing (14) and the other free end (42) is forcibly guided by guide elements (15) and simultaneously supports the spring-loaded follower (33). The toggle-joint lever pair (40) is supported on a control curve (51) of the eccentric element (50). The closing displacement is attained by the extension and/or bending of the toggle-joint lever pair. The follower then seizes the rotary latch (20) and propels it in a motor driven manner from its preliminary detent position into its primary detent position.

8 Claims, 4 Drawing Sheets

U.S. PATENT DOCUMENTS

| | | | | |
|---|---|---|---|---|
| 5,411,302 | A * | 5/1995 | Shimada | 292/201 |
| 5,423,582 | A | 6/1995 | Kleefeldt | |
| 6,079,237 | A * | 6/2000 | Hochart | 70/278.6 |
| 6,422,615 | B1 | 7/2002 | Roos et al. | |

FOREIGN PATENT DOCUMENTS

| | | |
|---|---|---|
| DE | 43 11 786 | 10/1994 |
| DE | 101 33 092 | 1/2003 |
| GB | 2 320 943 | 7/1998 |
| WO | 98/27301 | 6/1998 |

* cited by examiner

LOCK FOR VEHICLE DOORS OR LIDS

BACKGROUND OF THE INVENTION

1. Field of the Invention

The invention pertains to a lock which is installed in the area of the door or hatch and has a rotary catch. A locking part is located on the door post, and when the door or hatch is closed by hand, the locking part travels into the rotary catch, thus pivoting it initially from a spring-loaded open position into a pre-latching position. The pre-latching position of the rotary catch is secured by a spring-loaded pawl. Then the motor of a door-closing assist mechanism is turned on by control means. This mechanism, operating by way of a gearbox and a cam, moves the rotary catch from the prelatching position to the main latching position. The main latching position of the rotary catch is also secured by the pawl, which engages with a main notch provided on the rotary catch.

2. Description of the Related Art

Locks with motorized closing and opening mechanisms are known (WO 98/27301 A2), in which the gearbox has two takeoff routes, between which a gear element is installed with freedom to pivot. This lock has proven to be reliable, but it is bulky and expensive.

A lock of the type indicated in the introductory clause of claim 1 is known (DE 101 33 092 A1), which is less expensive that the previously described state of the art. In this known lock, the gearbox of the motor is engaged at all times and acts on two cams, one of which acts as a closing aid. This cam has a lobe, which, upon rotation of the motor, travels in one direction behind a shoulder of the rotary catch and, as previously mentioned, turns this from the-pre-latching position into the main latching position under the action of the motor. As a result, the locking part engaged in the rotary catch is also carried along, and the door is brought into its final closed position on the vehicle.

In the case of a lock of a different type (DE 43 11 786 C2), in which the rotary catch has neither a preliminary notch nor a main notch, the spring-loaded pawl is mounted on the free end of an actuating rod, the other end of which is driven by a motorized crank drive. A permanently supported rocker acts on the free end of the actuating rod. As the door is being closed and the rotary catch is being carried along, the movable pawl, which is spring-loaded, drops behind a shoulder of the rotary catch. When the motorized crank drive starts to turn, the pawl, which moves along with the actuating rod, carries the rotary catch along until it reaches the fully closed position. Then the motor stops, and the pawl remains engaged with the shoulder. At the same time, a lobe on the pawl travels under a fixed stop, which stops the movement of the free end of the actuating rod. The fixed stop is necessary so that, when the rotary catch is in the closed position, a hand or the motor can lift the pawl out of the rotary catch and hold it until the spring-loading force acting on the rotary catch can move the catch into its open position.

The invention has recognized that the disadvantage of the known lock is to be found in the direct connection between the cam and the rotary catch. For this reason, it is necessary to develop a new lock for each different type of vehicle to accommodate different sets of relationships. This not only requires the production and assembly of different lock elements, but also demands more complicated inventory control and increases the difficulty of repairing defective locks. Thus, for example, in the case of the previously mentioned known lock, it is not possible, when a change is made in the reduction ratio between the motor and the gearbox, simply to replace the gear wheels, without at the same time providing the rotary catch with a different external profile, in which the shoulder for the eccentrically moving lobe occupies a different position. In the case of the known lock, it was therefore necessary to develop a separate lock for each vehicle to accommodate the specific circumstances and, if necessary, to keep such locks in inventory. This led to a large amount of manufacturing work and to complicated inventory management.

SUMMARY OF THE INVENTION

The invention is based on the task of developing a reliable, inexpensive lock of the type above which can be used in vehicles of different types, because at most only slight modifications are required.

In the invention, a pair of toggle-joint levers is installed between the cam and the rotary catch. This pair of levers carries a spring-loaded driver at the free end. Because it is spring-loaded, the driver is held against a stationary end surface in the housing, at least when the catch is in the pre-latching position. The free end of the pair of toggle-joint levers serving to support the driver is guided positively by guide means in the lock housing. The other end of the pair of toggle-joint levers, i.e., the fixed end, is mounted rotatably on a stationary bearing. The cam has a control curve, against which the pair of toggle-joint levers is held under the force of a spring. The driver has a shoulder, to which is assigned an opposing shoulder on the rotary catch. The shoulder and the opposing shoulder are a certain distance apart in the open position, but when the motorized closing movement takes place, the pair of toggle-joint levers is shifted by the cam between different states of extension and/or inflection, during which the shoulder of the driver travels to the opposing shoulder of the rotary catch and moves the catch out of the pre-latching position into the main latching position.

In the invention, there is only an indirect connection between the cam and the rotary catch, namely, the connection established by the pair of toggle-joint levers and the driver articulated to them. So that the inventive lock can be applied to vehicles of different types, the cam, which has a certain defined control curve, can be easily replaced by a cam with a control curve of a different profile, the rest of the lock remaining unchanged. If necessary, however, it is possible, supplementally or alternatively, to remove the pair of toggle-joint levers and/or the driver and to replace them with other, similar components with different proportions and/or profiles. It is possible, for example, to change the arm length of the pair of toggle-joint levers. Because of the ease with which such modifications can be implemented, the inventive lock is universally applicable. Thus the inventive lock can be produced in much larger numbers, which means that production costs can be reduced.

It is recommended that a guide rod be used as the guide means for the free end of the pair of toggle-joint levers. One end of this guide rod is hinged to the free end of the pair of toggle-joint levers, whereas the other end is mounted on a stationary bearing. This stationary bearing can also be the bearing of the rotary catch.

BRIEF DESCRIPTION OF THE DRAWING

Additional measures and advantages of the invention can be derived from the subclaims, from the following description, and from the drawings. The drawings illustrate the invention in schematic fashion on the basis of an exemplary embodiment:

DETAILED DESCRIPTION OF THE INVENTION

Figure 1B:
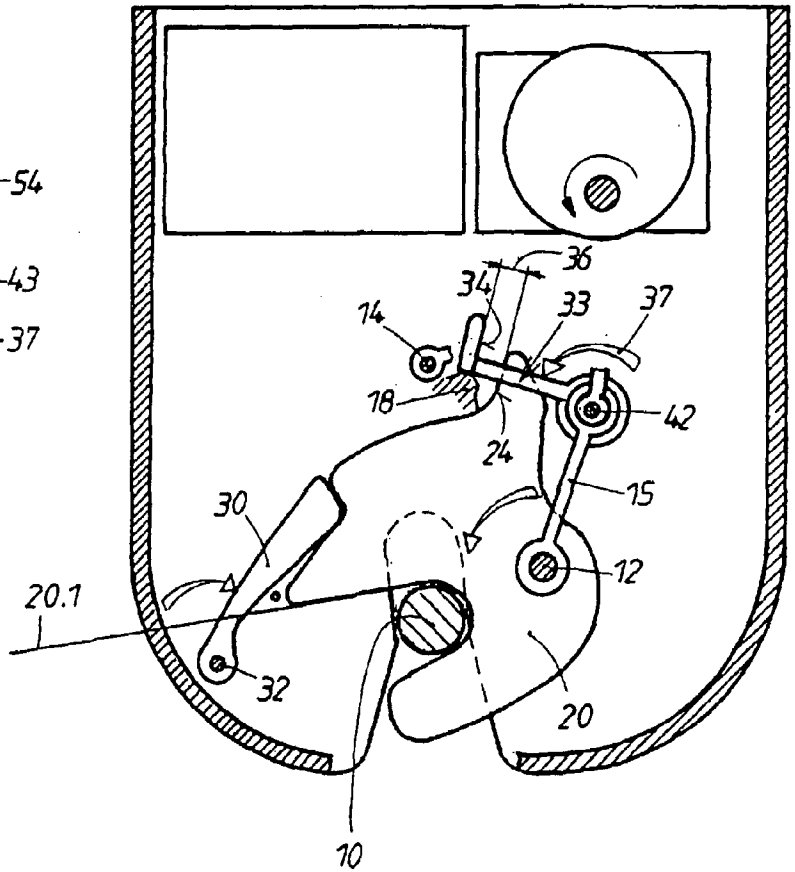
FIG. 1*b* shows the same lock and the same position of the lock parts as shown in FIG. 1*a*, except that some of the lock parts located at the top have been removed, namely, the pair of toggle-joint levers.

The lock has a lock housing 11 mounted on the door and a locking part 10 seated on the door post. In the lock housing 11, a rotary catch 20, which has a receptacle 23 for the locking part 10, is seated on a first, stationary bearing pin 12. When the door is open, the rotary catch is in its open position (not shown) in the lock housing 11, where the opening of the receptacle 23 is aligned with the slot 13 in the housing 11. The rotary catch 20 is spring-loaded in the direction toward its open position, as illustrated by the arrow 25 in FIG. 1*a*, and when in the open position it rests against end stops (not shown).

The door is first closed manually. As this happens, the locking part 10 travels into the receptacle 23, strikes the inner sidepiece, and thus rotates the catch 20 in the direction opposite its spring loading 25 until it reaches the "pre-latching position", characterized by the auxiliary line 20.1 in FIG. 1*b*. In this pre-latching position 20.1, a pawl 30, which is spring-loaded in the direction of the force arrow 35, thus engages with a first or preliminary notch 21, provided on the rotary catch 20. The pawl 30 is supported on a second stationary bearing pin 32 in the lock housing 11, and in this case the locking point 31 of the pawl grips the preliminary notch 21 on the catch. As a result, the rotary catch 20 is initially secured in its pre-latching position 20.1; the door is in a preliminary closed position.

Figure 1A:
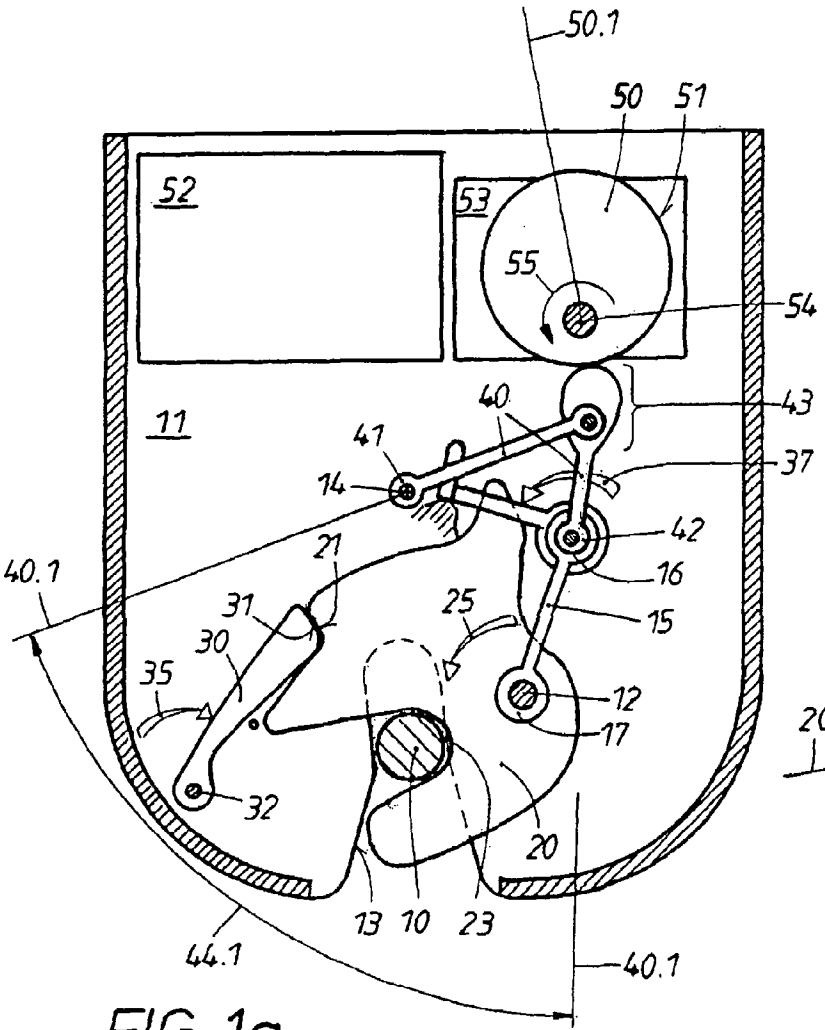
FIG. 1*a* shows a schematic diagram of the opened lock housing, seen from above, where the lock parts are in the so-called "pre-latching position", which is present when the door has been brought manually into an intermediate position, which does not yet represent the final closed position.

As can be seen in FIG. 1*a*, a pair of levers 40 is installed in the lock housing 11. These levers are connected to each other by a toggle joint 43 and are therefore called the "pair of toggle-joint levers" in the following. One end 41 of the pair of toggle-joint levers 40 is supported on a third stationary bearing pin 14 in the lock housing 11 and is therefore called the "fixed end" in the following. Although the other end 42 of the pair of toggle-joint levers 40 is able to move freely in the lock housing 11, it is guided positively by guide means. These guide means consist in the present case of a guide rod 15, one end 16 of which is hinged to the free end 42 of the pair of toggle-joint levers 40, whereas the other end 17 of the guide rod is held in a stationary bearing. To save space, the bearing 12 of the rotary catch 20 also serves as the bearing for the guide rod.

For reasons of clarity, the pair of toggle-joint levers 40 has been omitted from FIG. 1*b*, as previously mentioned. Only the bearing point for the guide rod 15 at the free end 42 of the pair of levers remains visible. At this bearing point, the driver 33 is also hinged to the free end 42 of the pair of levers. As can be seen in FIG. 1*b*, the driver 33 is spring-loaded in the direction of the force arrow 37. Because of this spring-loading 37, the driver is held against a stationary end surface 18 in the lock housing 11 when the catch is in the pre-latching position 20.1. This shoulder 34 is designed to cooperate with an opposing shoulder 24 on the rotary catch 20. In the open position 20.1 according to FIG. 1*b*, a gap 36 is present between the shoulder 34 and the opposing shoulder 24.

This spring-loading 37, which is also illustrated in FIG. 1*a*, cooperates with the guide means 15 to ensure that the pair of toggle-joint levers 40 is held elastically against a control curve 51 of a motorized cam 50. The associated motor 52 is installed in the area of the lock housing 11. The motor acts on a schematically indicated gearbox 53, the output of which is a shaft 54. The cam 50 is mounted nonrotatably on the shaft.

When the door and the rotary catch 20 have arrived in the pre-latching position 20.1 of FIGS. 1*a* and 1*b*, the motor 52 is turned on. This can be done by means of sensors (not shown), which respond when the lock parts arrive in a position which characterizes this pre-latching position 20.1. Then the cam 50 is rotated by the motor 52 in the direction of the arrow 55 of FIG. 1*a*, thus leaving its rest position indicated here by the number 50.1. This rest position 50.1 is present as long as the rotary catch is in the previously described open position and remains so until, as described above, the pre-latching position 20.1 is reached.

Figure 2B:
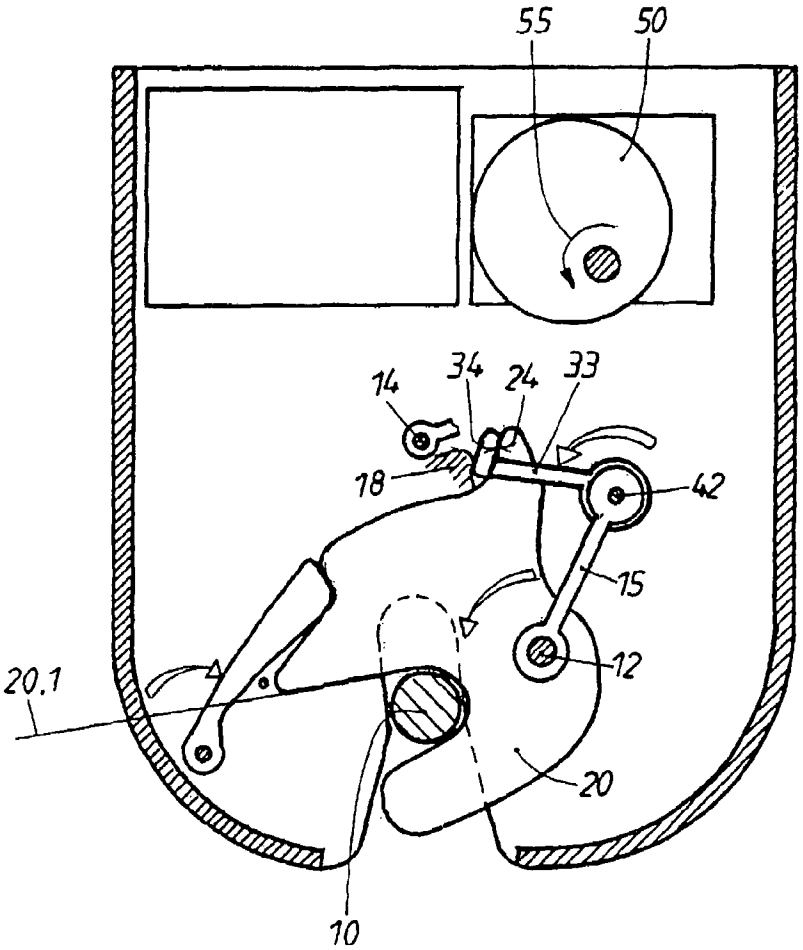
FIGS. 2*a* and 2*b* show views similar to those of FIGS. 1*a* and 1*b* of the same lock at the time when the motorized closing assist mechanism in the lock has been started.

In a manner similar to that shown in FIGS. 1*a* and 1*b*, FIGS. 2*a* and 2*b* show a special "intermediate position", which is reached as the cam 50 undergoes further rotation 55, illustrated here by the corresponding auxiliary line 50.2. This rotational position 50.2 has an effect on the position of the pair of toggle-joint levers 40; namely, the toggle joint 43 is pushed downward. Because of the positive guidance provided by the guide rod 15, however, as FIG. 2*b* shows, the free end 42 of the lever pair is pivoted around the bearing pin 12 by the guide rod 15, as a result of which the shoulder 34 of the driver 33 comes in contact with the opposing shoulder 24 of the catch 20. To allow this movement, the previously mentioned end surface 18 in the lock housing is provided with a suitable profile.

Figure 2A:
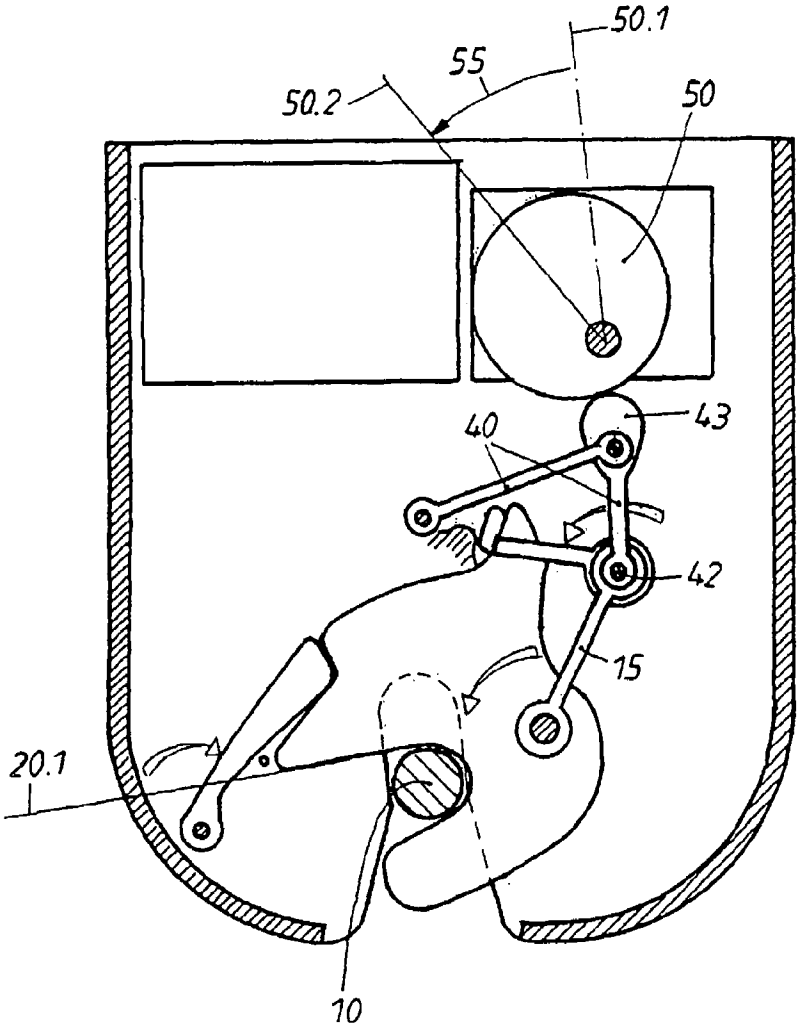
Figure 3B:
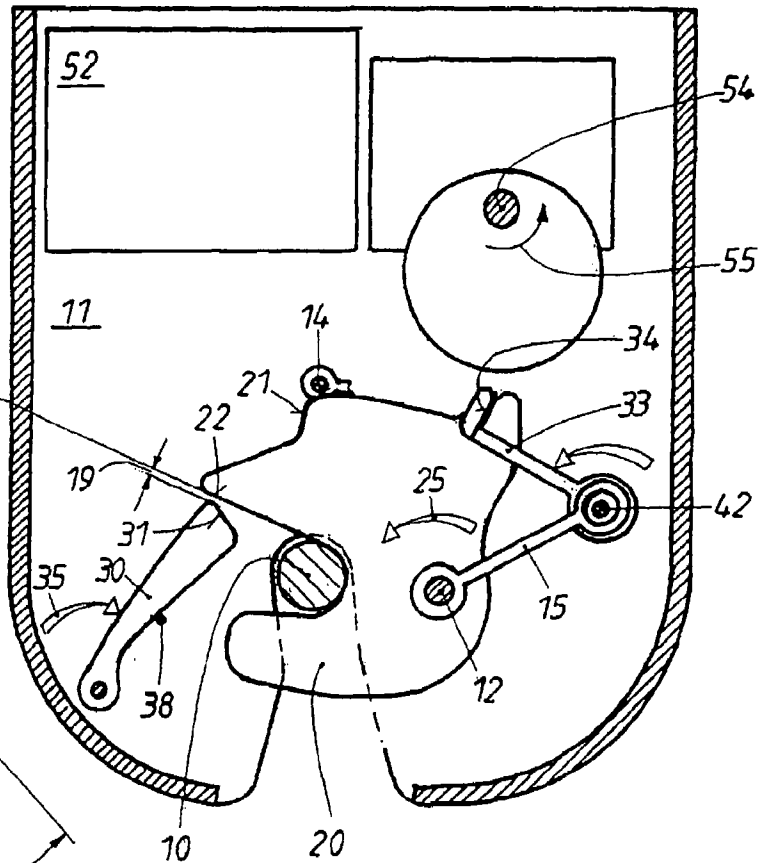
FIGS. 3*a* and 3*b* show the same lock at the end of the completed closing-assist process, where the components are now located in an "overstroke" position.

As the cam 50 undergoes further rotation 55 and thus passes beyond the intermediate position of FIGS. 2*a* and 2*b*, the rotary catch 20 is therefore carried along by the driver 33; the closing movement of the door with respect to the locking part 10 on the door post is thus provided with a motorized assist. FIGS. 2*a* and 2*b* show the beginning of this closing assist process, where the rotary catch 20 is still in its pre-latching position 20.1 shown in FIGS. 1*a* and 1*b*. This situation changes as the cam 50 moves to its "maximum" position shown in FIGS. 3*a* and 3*b*, illustrated there by the auxiliary line 50.3.

In the rest position 50.1 of the cam 50 according to FIG. 1*a*, the two levers of the toggle-joint lever pair 40 form a relatively small angle, indicated by the number 44.1. The toggle-joint lever pair 40 is in the "inflected" position here, as illustrated by the auxiliary lines 40.1 in FIG. 1*a*. In the maximum position 50.3 of FIG. 3*a*, the two levers of the pair 40 enclose a large angle, indicated by the number 44.2. The toggle-joint lever pair 40 is now in what amounts essentially to an "extended" position, indicated by the auxiliary lines 40.2 in FIG. 3*a*.

Figure 3A:
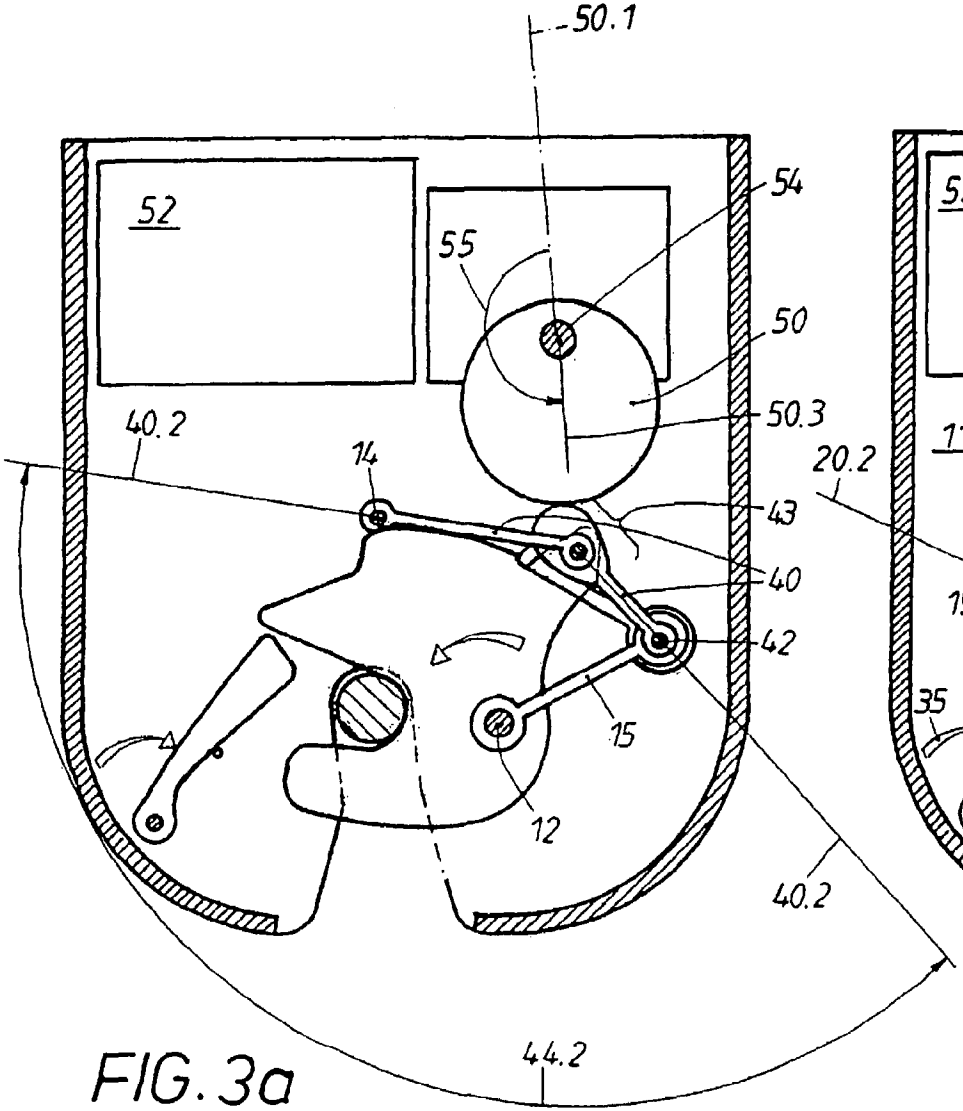

In FIG. 3*a*, the previously mentioned "closing assist" process has reached its maximum point. The free end 42 of the pair of toggle-joint levers 40 has moved onward to the maximum point under the guiding action of the guide rod 15.

As a result, the driver 33 has been carried along as well, and its shoulder 34 has turned the rotary catch 20 even farther around its bearing pin 12. The rotary catch 20 has thus been brought into the rotation al position indicated by the auxiliary line 20.2 in FIG. 3*b*, which is called the "overstroke" position. The gripped locking part 10, as can be seen FIG. 3*b*, has moved even deeper into the interior of the lock housing 11. In its overstroke position 20.2, the rotary catch 20 has turned so far that the locking point 31 of the pawl 30, under the action of the spring-loading illustrated by the arrow 35, can snap into a second or main notch 22 on the rotary catch 20. The pawl 30 can be held in the position in which it is aligned with the main notch 22 by rotation stops illustrated schematically at 38. As FIG. 3*b* shows, it is possible for a free gap 19 to remain between the locking point 33 and the main notch 22. This situation changes quickly, however, because the motor 52 is still running.

Figure 4B:
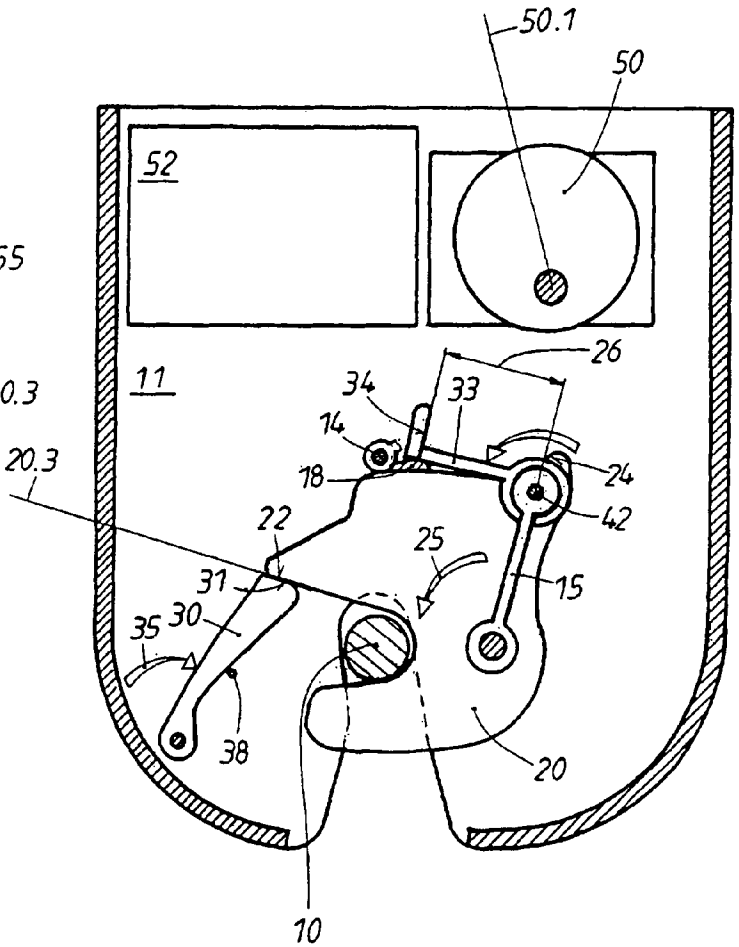
FIGS. 4*a* and 4*b* show the lock after the lock parts have arrived in a so-called "main latching position", which corresponds to the fully closed position of the door.
Figure 4A:
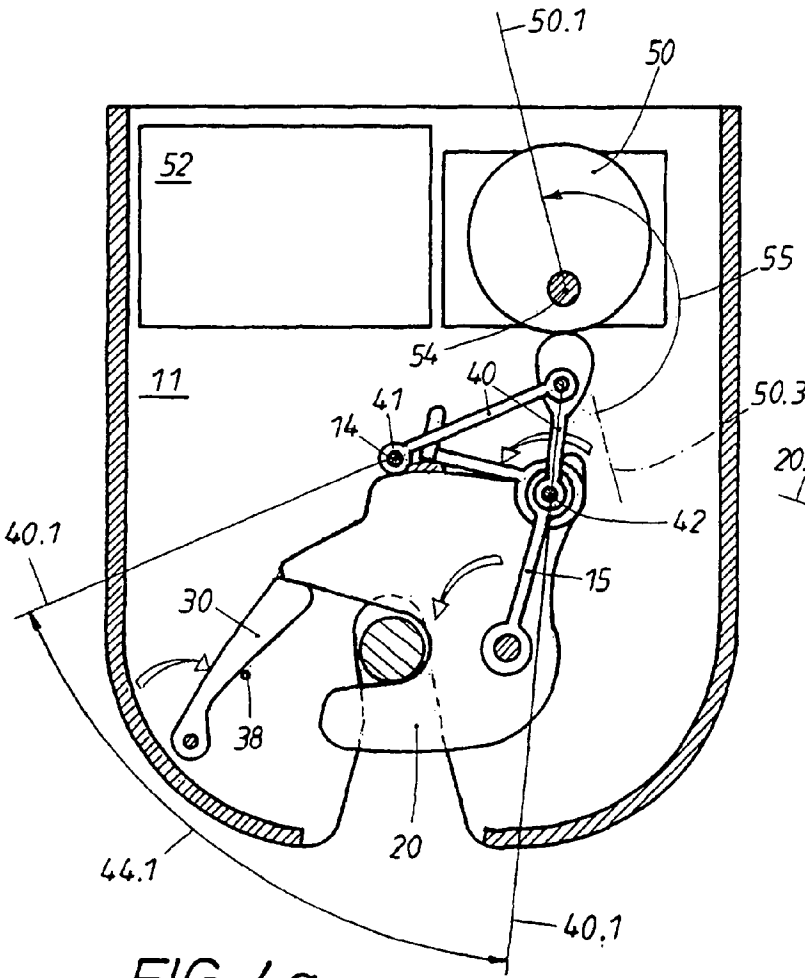

What then happens can be seen in FIGS. 4*a* and 4*b*. The cam 50 has again reached the position 50.1 of FIG. 1*a*. At this point the motor 52 is stopped. This can be accomplished by the use of limit switches, sensors, etc. As a result, the pair of toggle-joint levers 40 again arrives in the inflected position 40.1, indicated by the small angle 44.1. Now the free end 42 of the toggle-joint lever pair 40 is located again in its starting position of FIG. 1*a*, as a result of which the shoulder 34 of the driver 33, which is hinged at this free end, also returns to its original position, seen previously in FIG. 1*b*, resting on the end surface 18 on the housing. The associated opposing shoulder 24 on the rotary catch 20 is now a good distance away from the shoulder 34, as can be seen by the distance marked 26 in FIG. 4*b*.

This latter situation can be explained as follows. Because the rotary catch 20 is spring-loaded 25, when it is released it can rotate back the other way, but only over the distance of the free gap 19, previously described in FIG. 3*b*. As FIG. 4*b* shows, the main notch 22 of the rotary catch 20 then comes to rest against the locking point 31 of the pawl 30. As a result, during the remaining rotation 55 of the cam 50 in FIG. 4*a*, the rotary catch 20 is held in the position illustrated by the auxiliary line 20.3 in FIG. 4*b*, which can be referred to as the "main latching position". The locking part 10, which has been pulled into the lock housing 11, now assumes its final position there. The door is in its final, fully closed position, where the elastic seals between the door and the door opening in the vehicle are squeezed together. The inventive effect of the "closing assist" is complete.

The only thing needed to open the door is, as usual, to pull the locking point 31 of the pawl 30 away from the main notch 22 of FIG. 4*b*, namely, in the direction opposite the spring-loading 35. This can be done in various ways, e.g., by the same motor 52, although this possibility is not shown. The reactivation of the motor 52 can be accomplished by remote control, where again an intermediate stop in a pre-latching position 20.1 can be provided. The door can also be opened mechanically by the use of an inner or outer door handle, which acts by way of a chain of connecting elements (not shown) on the pawl 30. Insofar as the main latching position 20.3 is to be kept locked by means of, for example, a lock cylinder, provisions for unlocking it will be made in advance by means of a remote control device or by means of an electrical or mechanical key.

The inventive lock can be used equally effectively in vehicles of different types. Any modification which might be required can be accomplished quickly and easily. This can involve, for example, replacing the cam 50 shown in the figures, with a different one with a control curve 51 better suited to the specific requirements. Supplementally or alternatively, it would also be possible to provide the pair of toggle-joint levers 40 with different shapes and sizes, and also to replace the driver 33 and/or the guide rod 15 with elements with different profiles.

The bearing end 17 of the guide rod could also be mounted on a point which moves concomitantly with the rotary catch 20 instead of on the stationary bearing point 12. In place of a guide rod 15, a curved cam surface permanently connected to the housing could also be provided as a guide means, along which the free end 42 of the pair of toggle-joint levers 40 could slide or roll under positive guidance.

LIST OF REFERENCE NUMBERS

10 locking part
11 lock housing
12 bearing, first bearing pin in 11 for 20
13 slot in 11 for 10
14 bearing, third bearing pin in 11 for 43
15 guide means, guide rod
16 first end of guide rod 15 at 42
17 second end of guide rod 15 at 12
18 stationary end surface for 33 in 11
19 free gap between 31 and 22 (FIG. 3*b*)
20 rotary catch
20.1 pre-latching position of 20 (FIGS. 1*b*, 2*b*)
20.2 overstroke latching position of 20 (FIG. 3*b*)
20.3 main latching position of 20 (FIG. 4*b*)
21 preliminary notch of 20
22 main notch of 20
23 receptacle in 20 for 10
24 opposing shoulder on 20 for 34
25 arrow of the spring-loading of 20
26 free distance between 34 and 24 (FIG. 4*b*)
30 pawl
31 locking point of 30
32 bearing, second bearing pin on 11 for 30
33 driver
34 shoulder on 33 for 24
35 force arrow of the spring-loading of 30
36 distance between 24 and 34 (FIG. 1*b*)
37 arrow of the spring-loading of 33
38 rotation stop for 30 (FIG. 3*b*)
40 pair of toggle-joint levers
40.1 inflected position of 40 (FIGS. 1*a*, 4*a*)
40.2 extended position of 40 (FIG. 3*a*)
41 fixed end of 40
42 free end of 40
43 toggle-joint area of 40.
44.1 small angle at 40.1 (FIGS. 1*a*, 4*a*)
44.2 large angle at 40.2 (FIG. 3*a*)
50 cam
50.1 rest position of 50 (FIGS. 1*a*, 4*a*)
50.2 intermediate position of 50 (FIG. 2*a*)
50.3 maximum position of 50 (FIG. 3*a*)
51 control curve on outside circumference of 50
52 motor for 50
53 gearbox between 52 and 50
54 output shaft of 53 for 50
55 arrow of rotational movement of 50

The invention claim is:

1. Lock for doors or hatches of vehicles, with a permanently supported rotary catch (20), into which a locking part (10) travels when the door or hatch is closed, thus pivoting the rotary catch (20) from an initial open position into a pre-latching position (20.1);

where the rotary catch (20) is spring-loaded (25) in the direction toward its open position;

with a permanently supported, spring-loaded (35) pawl (30), which, when the catch is in the pre-latching position (20.1), engages with a preliminary notch (21) in the rotary catch (20);

with a motorized (52) closing assist mechanism for the door or hatch, comprising a gearbox (53) with a cam (50);

with control means for turning the motor (52) on and off;

where, when the motor is turned on, the movement (55) of the cam (50) moves the rotary catch (20) from the pre-latching position (20.1) to the main latching position (20.3), which is secured by the pawl (30), which engages with the main notch (22) of the rotary catch (20), wherein a pair of toggle-joint levers (40) and a spring-loaded driver (33) are installed between the cam (50) and the rotary catch (20); in that the driver (33) is hinged to the free end (42) of the toggle-joint lever pair (40), and the driver (33) is held by spring-loading (37) against a stationary end surface (18), at least when the rotary catch (20) is in the pre-latching position (20.1); in that the free end (42) of the toggle-joint lever pair (40) is positively guided by guide means (15) in the lock housing (11), whereas the other, fixed end (41) of the toggle-joint lever pair (40) is rotatably mounted on a stationary bearing (14); in that the cam (50) has a control curve (51), against which the toggle-joint lever pair (40) is held; and in that the driver (33) has a shoulder (34), which, when the catch is in the open position, is a certain distance away (36) from an opposing shoulder (24) provided on the rotary catch (20), whereas, during the motorized (52) closing movement, the toggle-joint lever pair (40) extends (40.2) or inflects (40.1), as a result of which the shoulder (34) of the driver (33) grips the opposing shoulder (24) of the rotary catch (20) and rotates the rotary catch (20) from its pre-latching position (20.1) to the main latching position (20.3).

2. Lock according to claim 1, wherein the toggle-joint lever pair (40) is held in the area (43) of its toggle joint against the cam (50).

3. Lock according to claim 1, wherein the guide means consists of a guide rod (15), one end (16) of which is hinged to the free end (42) of the toggle-joint lever pair (40), whereas the other end (17) of the guide rod is mounted on a stationary bearing (12).

4. Lock according to claim 3, wherein the stationary bearing of the guide rod (15) is simultaneously the bearing (12) of the rotary catch (20).

5. Lock according to claim 3, wherein the hinge point of the guide rod (15) on the toggle-joint lever pair (40) is simultaneously the hinge point for the driver (33).

6. Lock according to claim 1, wherein the spring-loading (37) of the driver (33) consists of a shank spring, which is seated in the area of the hinge point of the driver (33) on the free end (42) of the toggle-joint lever pair (40).

7. Lock according to claim 1, wherein the cam (50) has a defined control curve (51), and in that the cam (50) can be detached from the motor gearbox (53) and replaced by a cam with a control curve (51) of a different profile.

8. Lock according to claim 1, wherein the toggle-joint lever pair (40) and/or the driver (33) and/or the guide means (15) can be detached from the housing (11) and replaced by other, similar components with different proportions and/or different profiles.

* * * * *